United States Patent [19]

Rettich et al.

[11] 4,389,430

[45] Jun. 21, 1983

[54] METHOD AND ARRANGEMENT FOR COATING ORIFICE WALLS

[75] Inventors: Renate Rettich, New-Ulm; Wilhelm Schwedes, Ulm-Ermingen, both of Fed. Rep. of Germany

[73] Assignee: Licentia Patent-Verwaltungs-GmbH, Frankfurt am Main, Fed. Rep. of Germany

[21] Appl. No.: 318,913

[22] Filed: Nov. 6, 1981

[30] Foreign Application Priority Data

Nov. 7, 1980 [DE] Fed. Rep. of Germany ..... 3041986

[51] Int. Cl.[3] ..... B05C 7/06; B05C 5/02; B05D 1/28; B05D 7/22

[52] U.S. Cl. ..... 427/230; 401/120; 118/215; 118/254; 118/401

[58] Field of Search ..... 427/230; 118/401, 215, 118/254; 401/120

[56] References Cited

U.S. PATENT DOCUMENTS

| | | | |
|---|---|---|---|
| 1,612,452 | 12/1926 | Lormor | 118/215 |
| 3,335,700 | 8/1967 | Di Grado et al. | 118/215 |

FOREIGN PATENT DOCUMENTS

| | | |
|---|---|---|
| 2303355 | 9/1973 | Fed. Rep. of Germany . |
| 2719945 | 11/1978 | Fed. Rep. of Germany . |
| 74429144 | of 0000 | Fed. Rep. of Germany . |
| 1052063 | 12/1966 | United Kingdom . |

*Primary Examiner*—James R. Hoffman
*Attorney, Agent, or Firm*—Spencer & Kaye

[57] ABSTRACT

The walls of an orifice in a board are coated by a rod or tube which touches or dips into a liquid below the board. The walls are coated either by a capillary effect or by moving the rod or tube through the orifice. Several rods and/or tubes may be attached to a single holder for coating a plurality of selected orifices simultaneously.

13 Claims, 1 Drawing Figure

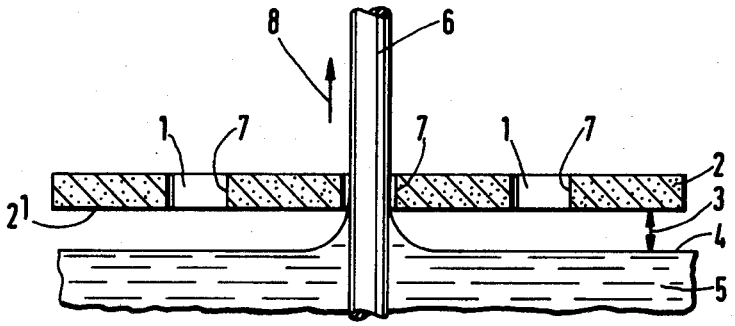
8
6
1
7
7
1
7
2
3
4
5
2'

METHOD AND ARRANGEMENT FOR COATING ORIFICE WALLS

BACKGROUND OF THE INVENTION

The invention relates to a method and arrangement for coating orifice walls, and more particularly to a method of coating the inner walls of at least one orifice of a perforated plate or board with a liquid.

Such a method is used in particular in so called raster orifice plates or boards in which, for example, inner walls of a certain number of orifices are to be coated with the same or a different material. It is important for some applications that only the inner walls of the orifices should be coated whereas the remaining parts of the raster orifice board are to remain uncoated.

German patent application No. P 30 33 962, which is not a prior publication, discloses a chemical process in which raster orifice plates or boards are treated with different liquid substances such that only the inner walls of the orifice are coated and multi-coloured coating is possible because of the use of masks, these masks preferably being in the form of self-adhesive films.

This type of masking process generally takes up a lot of material and/or time.

SUMMARY OF THE INVENTION

An object underlying the invention is to provide a simple and reliable process and arrangement for coating at least one orifice wall of a perforated plate or board, which make it possible to provide one or more coatings without using masks.

According to the invention there is provided a method of coating the inner walls of at least one orifice of a perforated plate or board with a liquid wherein the plate has a surface which is held substantially parallel to the surface of said liquid without touching said liquid, and at least one element at least touches said liquid through said at least one orifice and as a result of the movement of said element and/or as a result of the capillarity at the interface between said liquid and said element, said walls of said orifice are wetted by said liquid.

Further according to the invention there is provided an arrangement for coating the inner walls of at least one orifice with a liquid, comprising a perforated plate or board defining said orifice, said plate or board having a surface which is arranged substantially parallel to the surface of said liquid without touching said liquid, and at least one element which at least touches said liquid and which extends through said orifice, said walls of said orifice being wetted by said liquid either as a result of movement of said element or as a result of capillarity at the interface between said liquid and said element.

BRIEF DESCRIPTION OF THE FIGURE

The invention will now be described in greater detail, by way of example, with reference to the drawings, the single FIGURE of which shows a sectional view of an apertured board of an arrangement in accordance with the invention.

DESCRIPTION OF THE PREFERRED EMBODIMENT

Basically the present invention provides a method and arrangement for coating the inner walls of an orifice with a liquid by passing through the orifice a rod, tube or other element which also touches the surface of or extends into the liquid, the inner walls being coated either by a capillary effect or by movement of the rod, tube or other element.

The orifice is preferably a through hole. The element may comprise at least one cylindrical rod and/or at least one small tube and/or at least one element whose shape and/or surface encourages a capillarity effect. The element is preferably inserted into the orifice from below and moving out of the coating liquid.

The walls of a plurality of orifices may be coated simultaneously. In one method after the first coating process with a first liquid at least one other coating process is performed with at least one other liquid such that at least one orifice wall not coated during the first coating process and/or at least one orifice wall which has already been coated is coated with the other liquid.

In a preferred arrangment the diameter of the element is smaller than the diameter of the orifice by at least two coating thicknesses.

Referring now to the drawings, there is shown a plate or board 2 provided with at least one orifice 1, said plate or board being maintained approximately parallel to the surface 4 of a liquid 5 which is shown by hatching at a spacing 3 therefrom without actually touching the liquid. An element 6, a needle by way of example, which has a smaller diameter than the orifice 1, is placed through the orifice 1 so that it touches the liquid 5 or is dipped into the liquid and is wetted. The liquid 5 then rises up the element 6 as a result of capillarity. If the spacing 3 is selected to be smaller than or equal to this height and if the diameter of the element 6 is smaller than the diameter of the orifice 1 then the liquid 5 is able to rise into the orifice 1 so that the inner walls 7 of the orifice are coated. If the spacing 3 is larger then this coating is achieved when the element 6 is moved in the direction of the arrow 8.

In a further embodiment, not shown, several elements 6 are fixed to a retaining device or holder so that the inner walls of several orifices are coated in one coating process substantially simultaneously.

Furthermore, it is possible to select the holder and/or the number or arrangement of the elements 6 such that some inner orifice walls 7 are coated for example in a certain pattern and the inner orifice walls which have not been coated are coated with a different material by repeating this coating process with a different liquid, a different holder and/or altered positioning of the holder with respect to the orifice plate or board.

It will be understood that the above description of the present invention is susceptible to various modification changes and adaptations.

We claim:

1. A method of coating the inner walls of at least one orifice of a perforated plate or board with a liquid wherein the plate has a surface which is held substantially parallel to the surface of said liquid, without touching said liquid and at least one element at least touches said liquid through said at least one orifice and as a result of the movement of said element and/or as a result of the capillarity at the interface between said liquid and said element, said walls of said orifice are wetted by said liquid.

2. A method as defined in claim 1 wherein said orifice is a through hole.

3. A method as defined in claim 1 wherein said element comprises at least one cylindrical rod.

4. A method as defined in claim 1 wherein said element comprises at least one small tube.

5. A method as defined in claim 1 wherein capillarity occurs by virtue of the shape and/or the surface layer of said element.

6. A method as defined in claim 1 wherein the walls of a plurality of orifices are coated during one coating process substantially simultaneously.

7. A method as defined in claim 1 wherein after a first coating process with a first liquid at least one other coating process is performed with at least one other liquid such that at least one orifice wall not coated during said first coating process and/or at least one orifice wall which has already been coated is coated with said other liquid.

8. A method as defined in claim 1 wherein said element is inserted into said orifice which is to be coated from below and moving out of said liquid.

9. Apparatus for coating the inner walls of at least one orifice with a liquid comprising a perforated plate or board defining said orifice, said plate or board having a surface which is arranged substantially parallel to the surface of said liquid without touching said liquid, and at least one element which at least touches said liquid and which extends through said orifice, said walls of said orifice being wetted by said liquid either as a result of movement of said element or as a result of capillarity at the interface between said liquid and said element.

10. A method as defined in claim 1 wherein the diameter of said element is smaller than the diameter of said orifice which is to be coated by at least two coating thicknesses.

11. A method as defined in claim 1 wherein several said elements are fixed to a single holder.

12. A method as defined in claim 1 wherein said element is formed as a tube, its one end at least touching said liquid and its other end touching said plate, the inner or outer diameter of said tube being approximately equal to or greater than the diameter of said orifice, the axes of said orifice and said tube forming a substantially straight line, and the inner diameter of said tube and the diameter of said orifice being selected such that said liquid rises in said tube because of its capillarity and enters said orifice at least partially and as a result coats at least part of said orifice walls.

13. A method as defined in claim 1 wherein the element simultaneously touches said liquid and extends through said orifice.

* * * * *